US005899251A

United States Patent [19]

Turner

[11] Patent Number: 5,899,251

[45] Date of Patent: May 4, 1999

[54] WOOD MACHINEABLE JOINT

[76] Inventor: Allan William Turner, 21 Holts La., Bacchus Marsh, Victoria 3340, Australia

[21] Appl. No.: 08/893,151

[22] Filed: Jul. 15, 1997

[51] Int. Cl.[6] ..... B27F 1/00

[52] U.S. Cl. ..... 144/347; 144/85; 144/150; 144/87; 144/218; 144/219; 144/240; 144/241; 144/355; 144/371; 52/590.3; 52/590.1; 156/304.5; 156/256

[58] Field of Search ..... 144/85–87, 90.1, 144/91, 136.1, 150, 218, 219, 240, 241, 346, 347, 355, 371; 52/590.1, 590.3, 631; 156/250, 256, 304.1, 304.5, 258

[56] References Cited

U.S. PATENT DOCUMENTS

| | | | |
|---|---|---|---|
| 850,889 | 4/1907 | Kelly | 144/347 |
| 1,122,350 | 12/1914 | Wysong | 144/347 |
| 1,178,911 | 4/1916 | Frazzi | 52/590.3 |
| 1,833,098 | 11/1931 | Voytko | 52/590.3 |
| 2,002,228 | 5/1935 | Meyercord et al. | 144/347 |
| 5,357,728 | 10/1994 | Duncanson | 52/590.3 X |

*Primary Examiner*—W. Donald Bray
*Attorney, Agent, or Firm*—Dennison, Meserole, Scheiner & Schultz

[57] ABSTRACT

One or a plurality of machined timber elements of complimentary first and second configuration wherein each element is characterized by having at least one face surface (1,2) and one abutment surface (3,4) wherein said abutment surface incorporates in said first configuration an elongate undercut slot or female dovetail (5) and in said second configuration incorporates a correspondingly shaped, undercut elongate protuberance or male dovetail (8) and said abutment surface is not orthogonal in relation to said face surface such that said first timber element configuration and said second timber element configuration are adapted for co-operative engagement to effect the joining together of a first timber element incorporating said first timber element configuration with a second timber element incorporating said second timber element configuration whereby the undercut slot of said first timber element interengages with the protuberance of said second timber element to form a self locking joint.

4 Claims, 5 Drawing Sheets

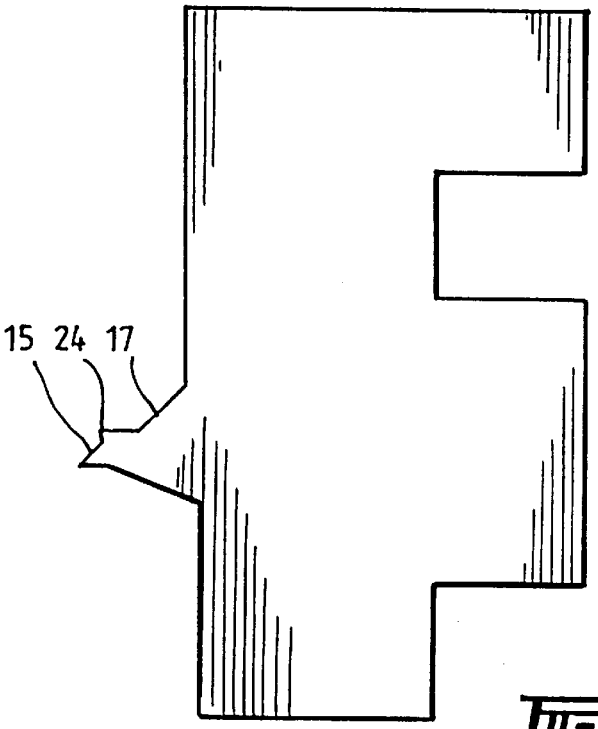
FIG. 4A.
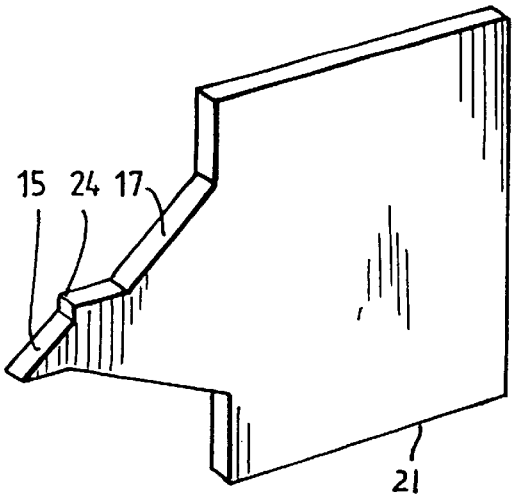
FIG. 4B.
FIG. 5A
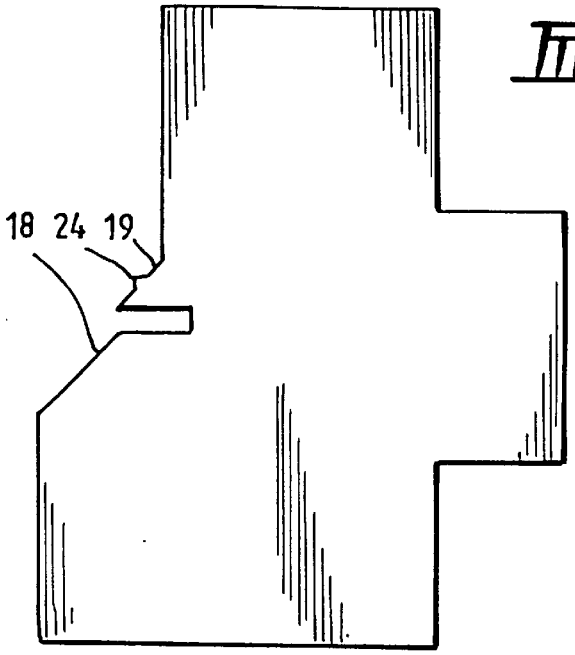
FIG. 5B.
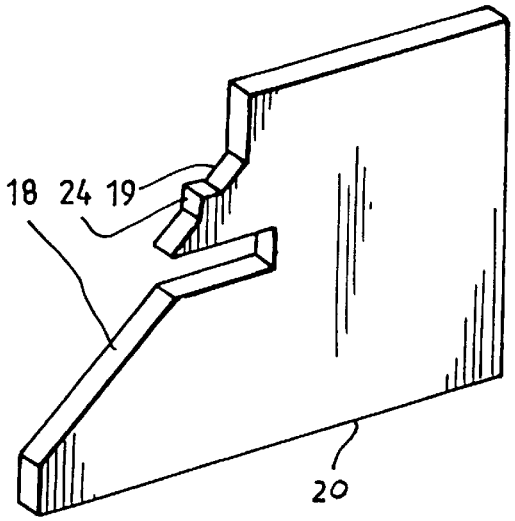

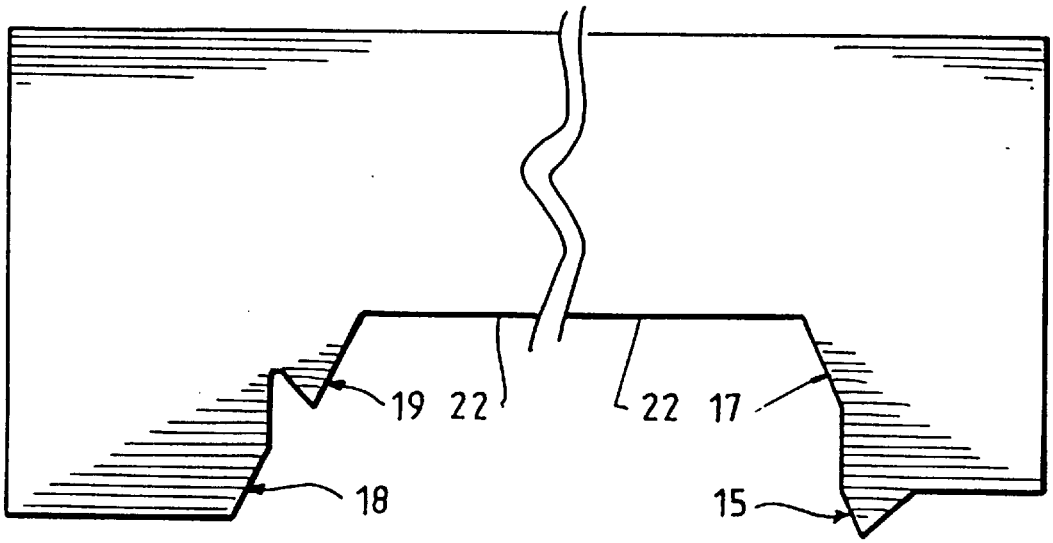
FIG. 7A.
FIG. 7B.
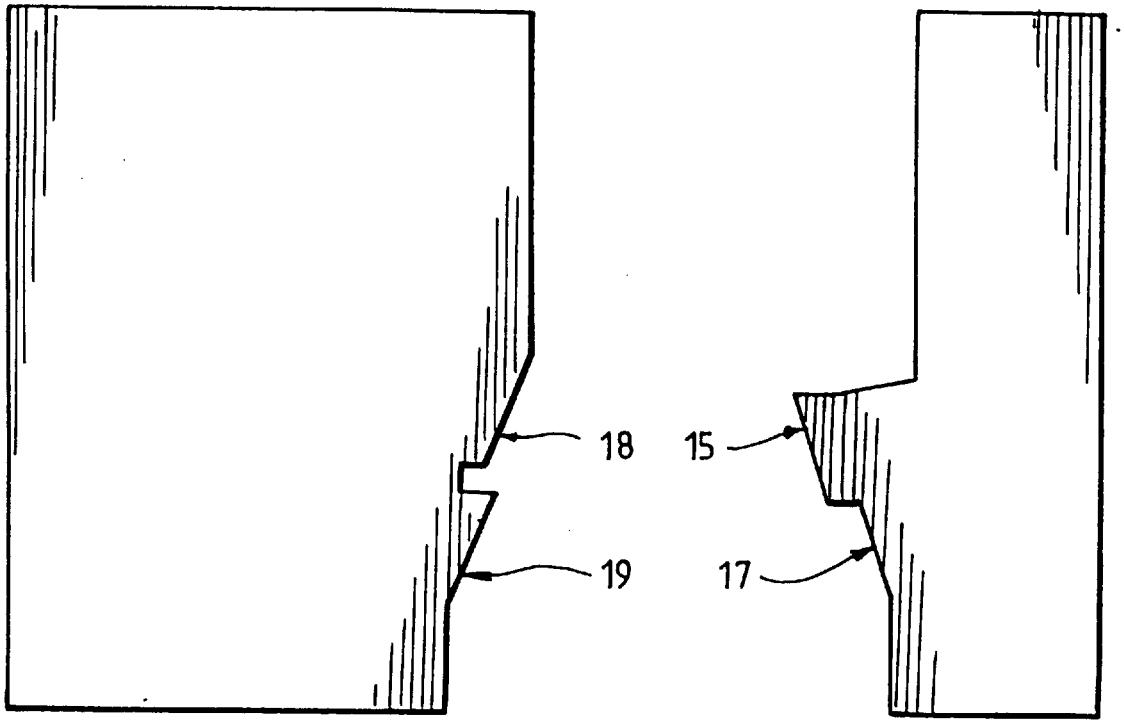
FIG. 7D.
FIG. 7C.

WOOD MACHINEABLE JOINT

INTRODUCTION TO INVENTION

This invention relates to wood machining and in particular to an improved method of joining discrete pieces of machined timber by the formation of an integral complimentary and co-operative interlocking joint in said discrete pieces of timber.

BACKGROUND TO INVENTION

Joining techniques in the timber trades date back to pre history and little in the form of timber joinery has not been explored or tried in one form or another. However, the more complex or demanding a joinery technique is to execute, in particular in an industrial or reproducible and economical fashion, the more likely it is that such a technique should be avoided for the obvious reasons of cost and efficiency.

Furthermore, industrial standards of accuracy and reproductability are very demanding and can rarely tolerate the vagaries associated with hand built joinery and/or the intricacies often practiced by experienced craftspeople.

The development of improved tools, in particular high speed power tools and machines has expanded the scope of joinery techniques available to industry and the general public. The hand held router for example, has revolutionized joinery for the general public, such that wood joinery techniques which were previously only able to be executed by experienced practitioners can be routinely used by virtually any operator of a hand held router.

Industry also makes extensive use of routers from simple hand held units familiar to the home handyman through a highly complex computer controlled multihead machines. In addition to the router, industry makes extensive use of the larger and more powerful shaper. The shaper can be considered a heavy duty version of the router, albeit utilizing a very different type mounting method for the cutters. The use of both routers and shapers in industry has lead to an ever increasing level of sophistication in the development of wood joining techniques used by industry.

The age old joining technique of dovetailing, which was traditionally used for the joining of drawer and carcass elements in furniture has experienced a colossal increase in application with the assistance of routers where dovetail shaped grooves can be easily made through a piece of timber to provide tapered slots. Such tapered slots can be used in co-operation with complimentary splines to provide a method of joining long lengths of timber together in a self locking joint which can be used as an edge-join, surface-join, end-join or any combination of the above.

The use of dovetails in the above method of joinery is very versatile; however, the configuration of the cutter used to produce a dovetail shaped slot in one pass requires the cutter to have wings extended beyond the width of the neck region of the cut so as to provide an undercut or inverted tapered slot expanding in width away from the face surface of the stock. This shape, which is necessary to allow the cutter to make the undercut dovetail slot in a single pass precludes the insertion or removal of the cutter at any point intermediate along the length of the effective cut. The cutter must be inserted into the stock, at the full depth of cut, at the beginning of the cut and remain fully within the cut until the very end of the cut.

Accordingly, dovetailed slots cut with a router must be cut at full depth for the whole length of the effective cut and cannot be plunged into or out of the stock intermediate of the cut.

Furthermore, a router cutter has a very small radius of cut which imposes limitations on the final quality of the cut surface. The routers very high speed partially compensates for this, but only if very sharp cutters are always used. The shaper, on the other hand, has a much greater radius of cut due to the positioning of the cutter knives at a chord across the rotating cutter head rather than axially in line with the rotating head as in the router. However, the shaper cutters are only capable of entering into stock at an angle normal to the axis of rotation of the cutters, unlike a router which can also enter stock in a direction axial to the cutter. Accordingly shaper cutters are not normally able to take cuts which involve any undercutting into the stock which characterize the dovetail joint.

The limitations in preparing dovetailed cuts with both routers and shapers as discussed above has restricted the use of this joinery technique, particularly in industry, to date. It would be very desirable if such dovetail shaped cuts could be made utilizing the benefit of the shaper, namely speed, accuracy, repeatability, low cost per linear meter and application to mass production.

STATEMENT OF THE INVENTION

One object of the invention is to provide an improved method of joining discrete pieces of machined timber.

A further object of the invention is to provide an improved configuration of machined timber.

Another object of the invention is to provide an improved cutter set for the preparation of machined timber.

In one aspect, the invention provides one or a plurality of machined timber elements of complimentary first and second configuration wherein each element is characterized by having at least one face surface and one abutment surface wherein said abutment surface incorporates in said first configuration an elongate undercut slot or female dovetail and in said second configuration incorporates a correspondingly shaped, undercut elongate protuberance or male dovetail and said abutment surface is not orthogonal in relation to said face surface such that said first timber element configuration and said second timber element configuration are adapted for co-operative engagement to effect the joining together of a first timber element incorporating said first timber element configuration with a second timber element incorporating said second timber element configuration whereby the undercut slot of said first timber element interengages with the protuberance of said second timber element to form a self locking joint.

The undercut slot and corresponding protuberance are preferably of symmetrical shape to allow inversion of the timber elements.

The abutment surface and face surface are preferably juxtaposed at 45° or 135° depending upon which face surface is references and the slot and protuberance are preferably positioned centrally on the respective abutment surfaces such that adjoining timber elements can be joined together in one plane or at right angles whilst maintaining the alignment of the respective face surfaces. Other angles including 60° and 67½° may be used to allow multiangle joining as required. Either or both the elongate slot or the male protuberance may also be provided with one or a plurality of longitudinal scores or microslots to act as an adhesive reservoir. Similarly, the abutment surfaces may also incorporate longitudinal scores to act as adhesive reservoirs.

In another aspect, the invention provides a method of joining machined timber elements comprising the preparation of complimentary machined timber elements of first and second configuration wherein each element is characterized by having at least one face surface and one abutment surface wherein said abutment surface incorporates in said first configuration an elongate undercut slot or female dovetail and said second configuration incorporates a correspondingly shaped, undercut protuberance or male dovetail and said abutment surface is not orthogonal in relation to said face surface such that said first timber element configuration and said second timber element configuration are adapted for co-operative longitudinal engagement of said protuberance and said slot to effect the joining together of a first timber element incorporating said first timber element configuration and a second timber element incorporating said second timber element configuration.

In another aspect, the invention provides a timber product incorporating timber elements joined together by the method of the invention.

In a still further aspect of the invention there is provided a method of forming co-operative abutment surfaces of timber elements comprising the steps of engaging a set of profiled cutters with a timber element, rotating said cutter set in a plane substantially parallel to a reference plane, relatively moving said rotating cutter set and said timber element in a direction which is tangent of the rotating cutter set thereby forming a first abutment surface and a first undercut lip, said first abutment surface extending at an angle of between 20° and 70° relative to joint reference plane, engaging said profile cutter set with said timber element and rotating said cutter set in a plane at right angles to said reference plane with the axis of rotation orthogonal to the reference plane, and relatively moving the cutter set and timber element to form a second abutment surface parallel to said first abutment surface and to form a second undercut lip spaced from the first undercut lip, said undercut lip comprising portions of an undercut slot or an undercut protuberance in or on the abutment surface. The specific steps of profile formation may be executed in any one of the available permutations without limitation provided that all the profile surfaces are formed in the machined timber.

In another aspect, the invention provides a set of cutters profiled to prepare the first and second abutment surfaces of 45° to the face surface comprising a first cutter adapted for shaping the first abutment surface and a second cutter for shaping the second abutment surface where in each of said first and second cutters are profiled to execute the respective abutment surface cuts in two passes with a 90° displacement such that no undercutting is required of any single cutter.

In yet another aspect the invention provides a set of cutters profiled to prepare the first and second abutment surfaces of other than 45° to the face surface comprising a first cutter set adapted for shaping the first abutment surface and a second cutter set adapted for shaping the second abutment surface said first and second cutter sets comprising two cutters.

DETAILED DESCRIPTION OF INVENTION

The invention will now be described in greater detail with reference to one particularly preferred embodiment as illustrated in the accompanying drawings, wherein:

FIG. 4A shows a template for making the female dovetail in FIG. 1;

FIG. 4B shows the actual cutter made from the FIG. 4A template;

FIG. 5A shows a template for making the male dovetail in FIG. 1;

FIG. 5B shows the actual cutter made from the FIG. 5A template;

FIG. 7A shows a template to produce one-half of the male abutment surface of 67½° with an internal orientation;

FIG. 7B shows a template to produce one-half of the female abutment surface of 67½° with an internal orientation;

FIG. 7C shows a template to produce a cutter to complete the female abutment of FIG. 7B;

FIG. 7D shows a template to produce a cutter to complete the male abutment of FIG. 7A;

Figure 1:
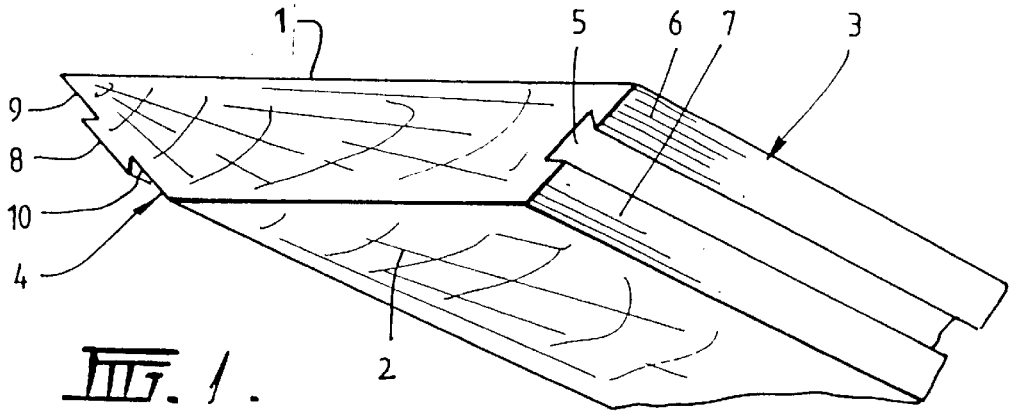
FIG. 1 is a perspective view of a machined timber element formed in accordance with the invention.

Referring first to FIG. 1 one aspect of the invention is shown with the configuration of a machined element of timber. The timber is shaped to have two substantially parallel dressed face surfaces 1 and 2 and two abutment surfaces 3 and 4 formed at 45° and 135° to the respective face surfaces and herein referred to as "45° abutment surface". The abutment surfaces 3 and 4 are provided in two complimentary and interlockable configurations. The first abutment surface 3 is provided with an elongate, longitudinal, undercut slot in the shape of a female dovetail 5. The remainder of the abutment surface 3 comprises two co-planar abutment faces 6 and 7 which are formed at 45° and 135° to each consecutive face surface 1 and 2. The second abutment surface 4 is provided with an elongate, longitudinal, undercut protuberance in the shape of a male dovetail 8. The remainder of the abutment surface 4 comprises two co-planar abutment faces 9 and 10. The shape of the abutment surfaces 3 and 4 are complimentary to each other and adapted for longitudinal sliding interengagement such that two discrete pieces of machined timber with corresponding female and male dovetails can be slidably engaged to effect a self locking joint. In the case of a joint which is glued together with adhesive, a suitable adhesive can be applied to both the abutment surfaces and the pieces of machined timber slidably engaged.

Figure 2:
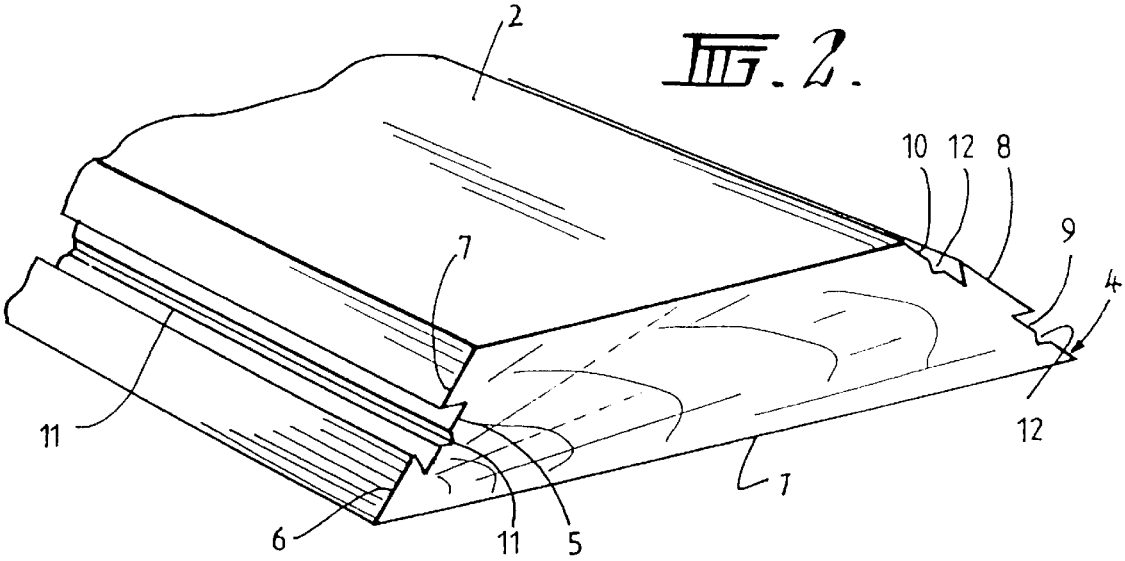
FIG. 2 is a close up view of a machined timber element detailing the adhesive reservoir microslots.

In order to facilitate adhesive distribution in an elongate joint, both abutment surfaces may be provided with adhesive reservoirs in the form of longitudinal slots 11 and 12. FIG. 2 shows such a longitudinal slot 11 formed on the inside of the female dovetail slot 5 and longitudinal slots 12 formed on either abutment faces 9 and 10 of the male dovetail abutment surface 4.

Figure 3A:
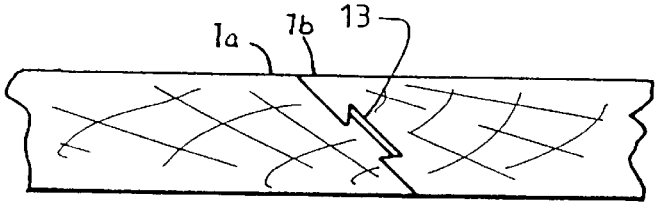
FIG. 3A shows a pair of machined timber elements of the type shown in FIG. 1 connected in linear fashion.
Figure 3B:
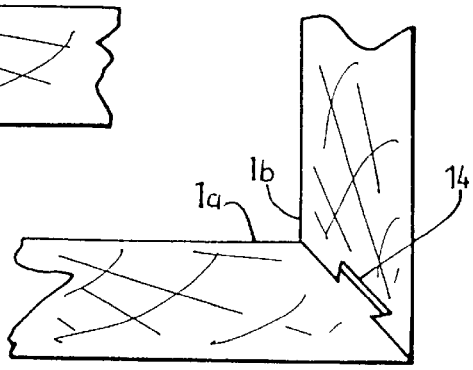
FIG. 3B shows the timber elements of FIG. 3A connected in an orthogonal manner.
Figure 6A:
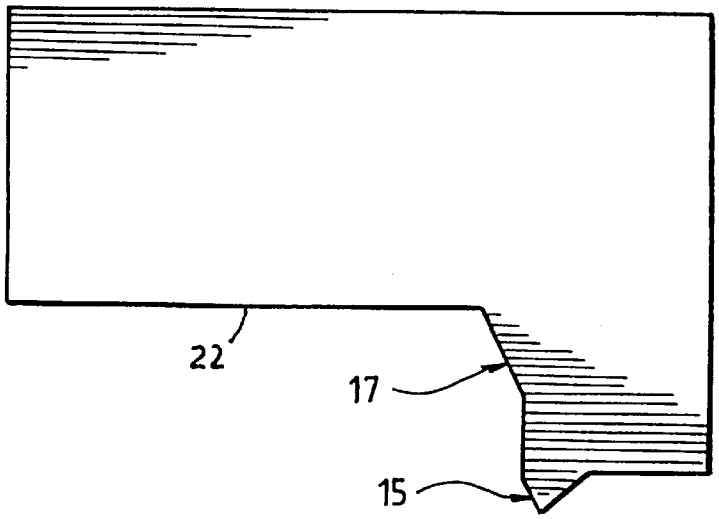
FIG. 6A shows a template for making one-half of the female dovetail to produce 67½° abutment surfaces.
Figure 6C:
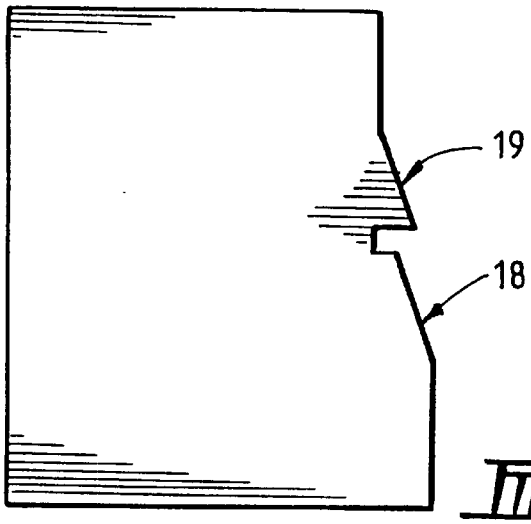
FIG. 6C shows a template for making one-half of the male dovetail to produce 67½° abutment surfaces.
Figure 6B:
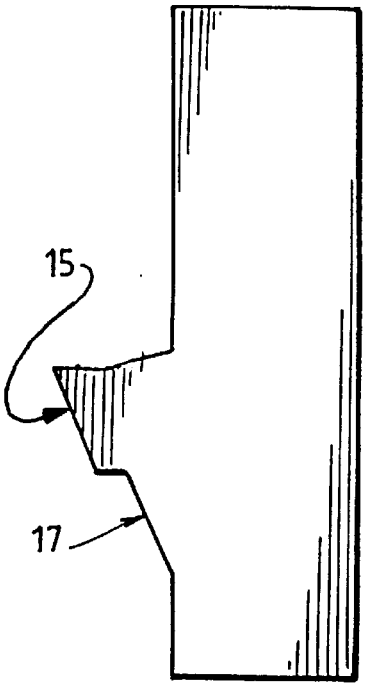
FIG. 6B shows a template for making the other half of the FIG. 6A female dovetail.
Figure 6D:
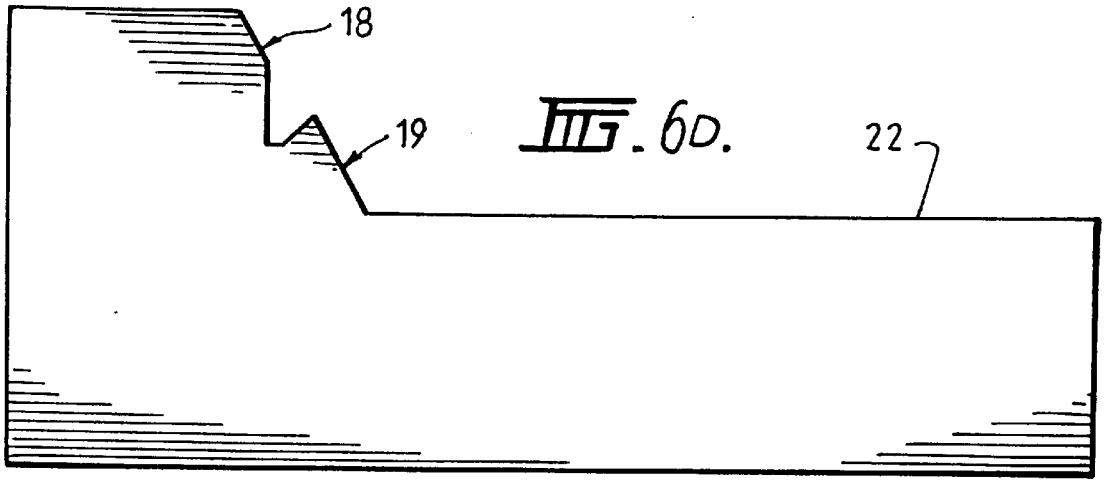
FIG. 6D shows a template for making the other half of the FIG. 6C male dovetail.

The abutment surfaces 3 and 4 are complimentary in two discrete planes. FIG. 3 shows the two planes of engagement possible with the 45° abutment surface. FIG. 3A shows engagement of two discrete machined timber elements in a linear plane such that a self-locking edge joint can be easily and reliably executed. FIG. 3B shows the same two discrete machined timber elements juxtaposed into an orthogonal plane to produce a 90° edge joint. The female and male dovetails are centrally positioned on the abutment surfaces to ensure the alignment of the mating face surfaces 1*a* and 1*b*.

In order to provide for the tolerance required to allow an easy sliding engagement of two timber elements it is desirable to ensure that the two abutment profiles are not an "exact fit". Accordingly, the male and female dovetails may be dimensioned to provide a small clearance gap 13 and 14, once the joint is completed. Such a gap of about 0.2 mm provides the degree of tolerance required to allow easy engagement as well as providing an additional reservoir for adhesive which also assists in assembly by providing an adhesive lubrication surface.

The machined timber elements of the invention may be prepared using an array of standard cutters available for routers, for example a combination of a chamfering cutter and a dovetail cutter offset at 45° would be able to produce the essential features of the profiles of the machined timber elements. However, as discussed, a router has numerous disadvantages in industrial application where many linear meters of stock require quick and reliable production. In such a situation, use of a shaper head is the preferred method for producing profiles in timber. However, the inability of a shaper to directly produce an undercut profile prohibits its application to the cutting of dovetail slots, at least in a single pass. In order to overcome such a limitation the invention provides, in another aspect, cutters adapted for use on a shaper. With the unique cutters of the invention, the female and male 45° abutment surfaces each require only one dedicated cutter which can produce the profile of the female and male abutment surfaces respectively with two consecutive passes, each pass being executed at a 90° offset to the original pass.

FIG. 4 shows the cutter and template for the 45° female abutment surface and FIG. 5 shows the cutter and template for the 45° male abutment surface.

The cutter templates are the guides used for grinding the shaper cutters and they reflect the relative shape and configuration of the final cutter profiles.

Referring firstly to FIG. 4A the template for the female abutment face has a first leading edge 15 for producing the female dovetail slot 5 and a second leading edge 17 for producing the abutment face 6 or 7. The small protuberance 24 forms the longitudinal slot which acts as an adhesive reservoir. The female template has been designed to produce a cutter 21 shown in FIG. 4B with no vertical cutting edges to maximize regrinding potential of the cutter as a vertical cutting edge cannot be reground without loss of cutter profile.

FIG. 5A shows the template for the male abutment surface which has a first leading edge 18 for producing the male protruding dovetail 8 and a second leading edge 19 for producing the abutment face 9 or 10. The small protuberance 24 forms the longitudinal adhesive reservoir slot. The male template has also been designed to produce a cutter 20 shown in FIG. 5B with no vertical cutting edges to maximize regrinding potential of the male cutter. The 45° configuration of the abutment surfaces allows each of the male and female abutment surfaces to be produced in two separate cuts using the same cutter orientated orthogonally, requiring a total of only two cutters.

FIGS. 6A to D illustrate the template configuration required to produce abutment surfaces of 67½° with an offset orientation of the abutment surfaces. Of course, the production of an abutment surface other than 45° precludes the dual use of a single cutter orientated orthogonally to produce the abutment surface and requires the use of four separate cutters as depicted in FIGS. A to D. Template 6A depicts the profile of a cutter required to produce one half of the female abutment surface by rotation about an axis parallel with the face surface of the timber stock. The template has a first leading edge 15 for producing one half of the female dovetail slot 5 and a second leading edge 17 for producing the abutment face 7. Template 6B complete the other half of the female abutment surface by rotating about an axis orthogonal to the template 6A. The template 6B has a first leading edge 15 for producing the second half of the female dovetail slot 5 and a second leading edge 17 for producing the abutment face 6.

Template 6C depicts the profile of a cutter required to produce one half of the male abutment surface by rotation orthogonal to the face surface of the timber stock. The template 6C has a first leading edge 18 for producing one half of the male protruding dovetail 8 and a second leading edge 19 for producing the abutment face 9.

Template 6D completes the other half of the male abutment surface by rotating about an axis parallel with the face surface. Template 6D has a leading edge 18 for producing the other half of the male protruding dovetail 8 and a second leading edge 19 for producing the abutment face 10.

The templates 6A and 6D can optionally incorporate straight cutters 22 for surfacing the face surfaces of the timber elements without the need for a separate machining step.

FIGS. 7A to D illustrate the template configurations required to produce abutment surfaces of 67½° with an internal orientation of the abutment surfaces. The configuration of the internal version of the timber element allows two of the four templates A and B to be combined into a single cutter if so desired with templates A and B rotating about an axis parallel with the face surface of the timber stock. Template 7A depicts the profile of a cutter required to produce one half of the male abutment surface with a first leading edge 18 for producing one half of the male protruding dovetail 8 and a second leading edge 19 for producing the abutment face 10. Template 7B depicts the profile of a cutter required to produce one half of the female abutment surface with a first leading edge 15 for producing one half of the female dovetail slot 5 and a second leading edge 17 for producing the abutment face 7. Both templates 7A and 7B can incorporate a straight edge 22 such that when a combined cutter is used from templates A and B, the length of the straight cutter 22 would determine the width of the machined timber element.

The remaining halves of the two abutments surfaces are finished by use of cutters described from templates 7C and 7D which both rotate in an axis orthogonal to the face surface of the stock. Template 7C depicts the profile of a cutter required to complete the female abutment surface with a first leading edge 15 for finishing the female dovetail slot 5 and a second leading edge 17 for producing the abutment face 3. Template 7D depicts the profile of a cutter required to complete the male abutment surface with a first leading edge 18 for completing the male protruding dovetail 8 and a second leading edge 19 for producing the abutment face 9.

FIGS. 8A to E illustrate the various machining stages involved in the method of the invention.

The preferred machine for use in the method of the invention is a seven head shaper, although a minimum of four heads is required to machine prepared square dressed stock in one pass.

Figure 8A:
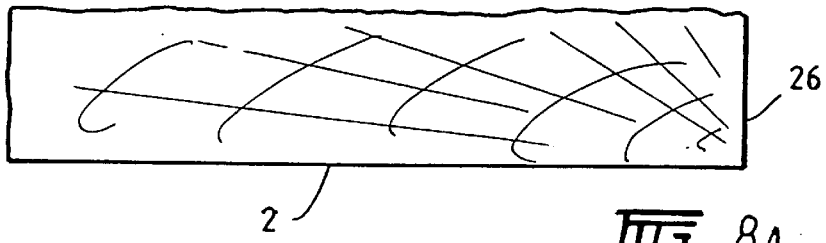
FIG. 8A shows a dressed timber to be provided with joining dovetails.
Figure 8B:
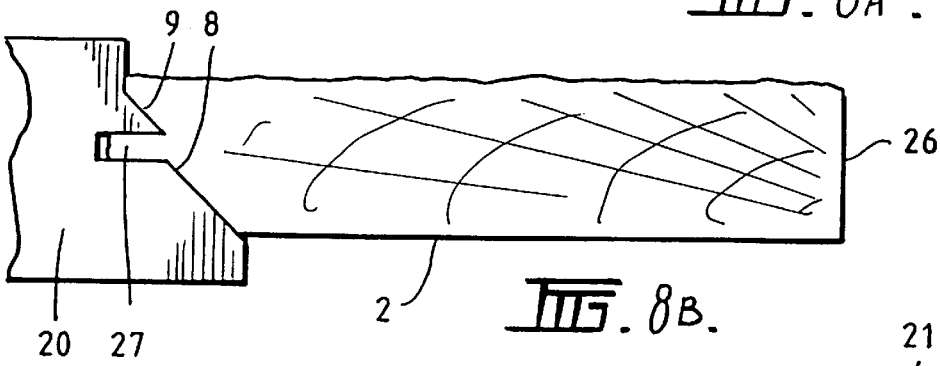
FIG. 8B shows the timber of FIG. 8A being worked to provide one-half of the male dovetail.
Figure 8C:
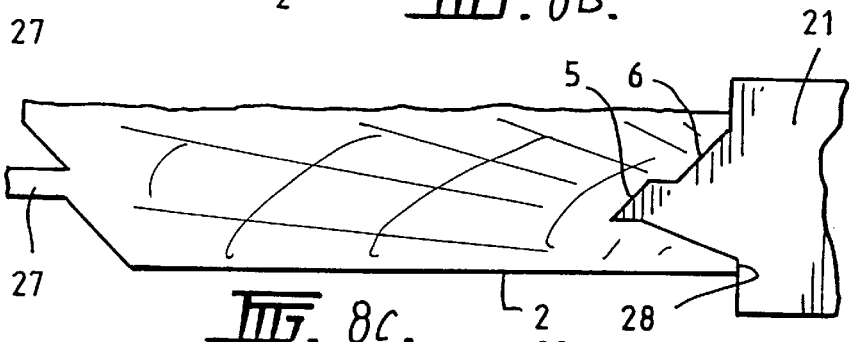
FIG. 8C shows the timber of FIG. 8B being worked to supply one-half of the female dovetail.

FIG. 8A shows partially dressed stock having one face surface 2 and one edge surface 26 already dressed. At this stage the stock is presented to the first cutter head bearing the male cutter 20 in a horizontal orientation. During this pass shown in FIG. 8B the male cutter produces an abutment face 9 and half of the male dovetail 8 of the second abutment surface 4. In order to facilitate accurate and damage free handling of the partially machined stock as it passes through the multihead shaper a locating nib 27 is temporarily machined into the stock to produce a guide surface other than the newly machined stock which can pass over rollers during the movement of the stock to the next shape head. The next pass is shown in FIG. 8C where the stock is presented to the female cutter 21 for cutting of the abutment face 6 and half of the female dovetail 5 of the first abutment surface 3. The female cutter although not specifically forming a locating nib on the stock, does allow for the retention of a small part of the original edge surface 26 as a temporary locating nib 28 for stock guidance during the following passes.

Figure 8D:
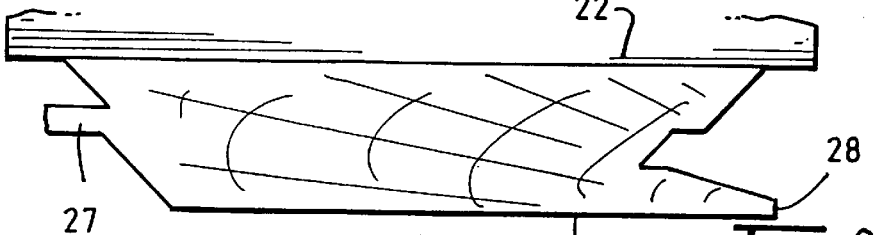
FIG. 8D shows the timber of FIG. 8C being surface dressed.

The next pass is shown in FIG. 8D where the stock is thicknesses with a straight cutter 22.

Figure 8E:
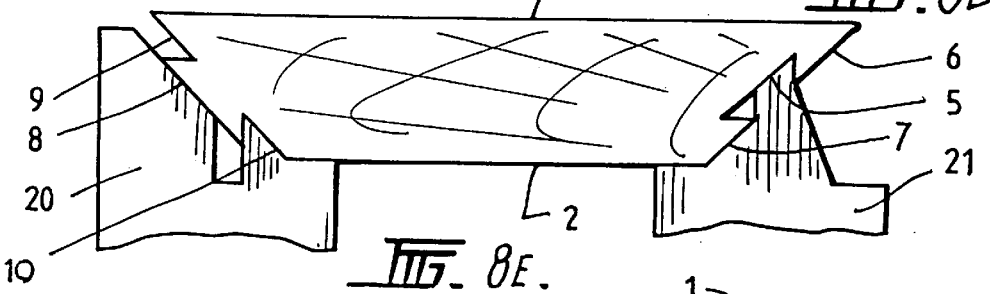
FIG. 8E shows the timber of FIG. 8D being simultaneously worked to provide the other male and female halves of the dovetails.

The next pass is shown in FIG. 8E where the female and male cutters are orientated orthogonally to finish the abutment cuts. The male cutter 20 completes the second abutment surface by cutting the face 10 and the remaining half of the dovetail 8. At the same time the remaining half of the male dovetail is formed the temporary locating nib 27 is eliminated. The female cuter 21 completes the first abutment surface by cutting the face 7 and the remaining half of the dovetail slot 5. Similarly, the 90° reorientation of the female cutter also eliminates the temporary locating nib 28.

Figure 8F:
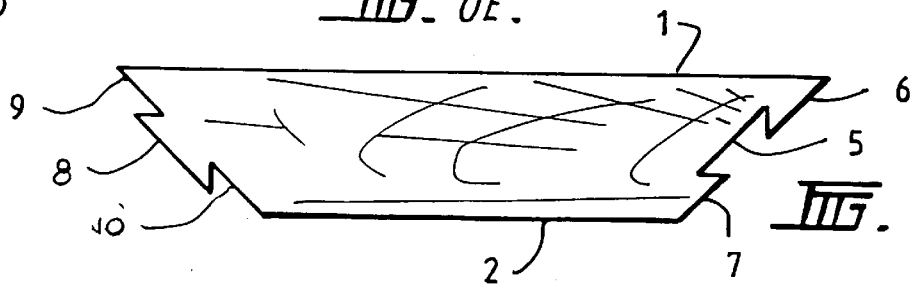
FIG. 8F shows the completed dovetail joints.

FIG. 8F shows the fully machined piece of timber emerges from the multihead shaper fully prepared and ready for assembly as shown in FIGS. 2 and 3.

The above described method of forming co-operative abutment surfaces in wood by use of conventional wood machining equipment and the sequencing of particular profiling steps is of course only one particularly preferred form which the invention may take. The invention has its primary application to natural wood products but may be applied to the ever increasing range of man made materials including medium density fiberboard, plywood and plastics material.

The invention provides for the first time a machined timber profile, capable of mass production using high speed multihead shaper equipment which is capable of forming a self locking edge on right angled joint in timber. The production of a 45° abutment surface allows the versatile adaptation of the joint whilst providing a higher glue surface area than used in conventional edge joining techniques.

The use of complimentary abutment surfaces also allows the use of a single cutter for each abutment surface by the 90° orientation of each consecutive cutter. The limitation to two cutters provide a cost effective method of tooling up with the minimum investment in cutters and templates. The machined timber products per se can provide a high value added component to many timber products, in particular the method of the invention provides a viable means of joining large volumes of relatively narrow timber stock together lengthwise to manufacture artificially wide timber boards with a high added value from a plurality of lower value narrow boards. The method may also be used in conjunction with known finger forming techniques to produce large sheet products of "natural" timber. In this manner the differential behavioural characteristics of each piece of timber can be limited such that relatively stable large sheet products can be manufactured from solid timber stock. Such products may find ready application for flooring etc. Many other application of the invention are possible and the above disclosures should not be considered limiting in any way.

Those skilled in the art will appreciated that the invention described herein is susceptible to variations and modifications other than those specifically disclosed. It is to be understood that the invention is considered to encompass all such variations and modifications that are all within its spirit and scope.

I claim:

1. A method of forming co-operative abutment surfaces of timer elements comprising the steps of engaging a set of profiled cutters with a timber element, rotating said cutter set in a plane substantially parallel to a reference plane of said timber element, relatively moving said rotating cutter set and said timber element in a direction which is tangent of the rotating cutter set thereby forming a pair of first abutment faces and a pair of first undercut lips, said first abutment faces extending at an angle of approximately 45° relative to said reference plane, engaging said profile cutter set with said timber element and rotating said cutter set in a plane at right angles to said reference plane with the axis of rotation perpendicular to the reference plane, and relatively moving the cutter set and timber element to form a second pair of abutment faces parallel to said first pair of abutment faces and to form a second pair of undercut lips spaced from the first pair of undercut lips, said first and second pairs of undercut lips comprising portions of an undercut slot and an undercut protuberance on the abutment surfaces.

2. A method of joining machined timber elements comprising the preparation of complimentary machined timber elements of first and second configuration in accordance with the method of claim 1 wherein each element is characterized by having at least one face surface and one abutment surface wherein said abutment surface incorporates in said first configuration an elongate undercut slot and said second configuration incorporates a correspondingly shaped, undercut protuberance said abutment surface is not orthogonal in relation to said face surface such that said first timber element configuration and said second timber element configuration are adapted for co-operative longitudinal engagement of said protuberance with said slot to effect the joining together of a first timber element incorporating said first timber element configuration and a second timber element incorporating said second timber element configuration.

3. A method of forming co-operative abutment surfaces of timber elements comprising the steps of engaging a first set of profiled cutters with a timber element, rotating said first cutter set in a plane substantially parallel to a reference plane of said timber element, relatively moving said first rotating cuter set and said timber elements in a direction which is tangent of the rotating cutter set thereby forming a pair of first abutment faces and a pair of first undercut lips, said first abutment faces extending at an angle other than 45° relative to said reference plane, engaging a second profile cutter set with said timber element and rotating said second cutter set in a plane at right angles to said reference plane with the axis of rotation perpendicular to the reference plane, and relatively moving the second cutter set and timber element to form a second pair of abutment faces parallel to said first pair of abutment faces and to form a second pair of undercut lips spaced from the first pair of undercut lips, said first and second pairs of undercut lips comprising portions of an undercut slot and an undercut protuberance on the abutment surfaces.

4. The method of claim 3, wherein the first and second sets of profiled cutters are of different shape.

* * * * *